US005128645A

United States Patent [19]

Suda

[11] Patent Number: 5,128,645

[45] Date of Patent: Jul. 7, 1992

[54] IGNITION COIL FOR AN INTERNAL COMBUSTION ENGINE

[75] Inventor: Koichi Suda, Aichi, Japan

[73] Assignee: Aisan Koygo Kabushiki Kaisha, Aichi, Japan

[21] Appl. No.: 608,713

[22] Filed: Nov. 5, 1990

[30] Foreign Application Priority Data

Nov. 7, 1989 [JP] Japan ..... 1-289037

[51] Int. Cl.[5] ..... H01F 17/06; H01F 27/24

[52] U.S. Cl. ..... 336/110; 336/178; 336/212

[58] Field of Search ..... 123/634; 336/110, 178, 336/165, 212, 233, 234

[56] References Cited

U.S. PATENT DOCUMENTS

| | | | |
|---|---|---|---|
| 1,545,429 | 7/1925 | Hunt | 336/178 |
| 2,381,763 | 8/1945 | McCreary | 336/110 |
| 2,869,050 | 1/1959 | Vanurk et al. | 336/110 |
| 3,209,295 | 9/1965 | Baermann | 336/110 |
| 3,968,465 | 7/1976 | Fukui et al. | 336/170 |
| 4,546,753 | 10/1985 | Piernet | 336/110 X |
| 4,627,407 | 12/1986 | Betz | 336/110 |
| 4,866,409 | 9/1989 | Umpzaki | 336/178 |
| 4,990,881 | 2/1991 | Ooyabu | 336/110 |

FOREIGN PATENT DOCUMENTS

| | | | |
|---|---|---|---|
| 2464543 | 6/1981 | France | 123/634 |
| 412082 | 2/1967 | Japan . | |
| 4849425 | 6/1973 | Japan . | |
| 59-167006 | 9/1984 | Japan . | |
| 60-218810 | 11/1985 | Japan . | |
| 63-109265 | 5/1988 | Japan . | |

*Primary Examiner*—Thomas J. Kozma
*Attorney, Agent, or Firm*—Oliff & Berridge

[57] ABSTRACT

The invention is directed to an ignition coil for use in an internal combustion engine. The ignition coil includes a core having at least two parts between which a gap is formed. A primary winding and a secondary winding are mounted on the core in such a manner that the gap of the core is substantially enclosed in the primary winding at least. A permanent magnet, whose cross section is larger in area than the cross section of the core, is disposed in the gap of the core to form a substantially closed magnetic circuit with the core. Preferably, there are disposed a primary bobbin for mounting thereon the primary winding and receiving therein the permanent magnet, and a secondary bobbin for mounting thereon the secondary winding and receiving therein the primary bobbin with the primary winding mounted thereon.

6 Claims, 2 Drawing Sheets

IGNITION COIL FOR AN INTERNAL COMBUSTION ENGINE

BACKGROUND OF THE INVENTION

1. Field of the Invention

The present invention relates to an ignition coil for an internal combustion engine, and more particularly to an ignition coil having a permanent magnet disposed in a magnetic circuit.

2. Description of the Related Art

In an ignition system for an internal combustion engine, when a primary current in an ignition coil is intermittently interrupted, a high voltage is obtained from a secondary winding in proportion to the rate of variation of the magnetic flux produced in a core and delivered to an ignition plug to ignite a mixture within a cylinder of the engine.

According to a recent internal combustion engine with its power output increased, the ignition coil requires that its output voltage and discharge energy are increased. Therefore, it is necessary that the cross sectional area of the core is increased, and/or the number of turns of the secondary winding mounted on the core is increased. By so doing, however, the size of the ignition coil will be made larger against a demand for the ignition system of its size reduced as a whole.

As well known and described in Japanese Utility Model Laid-open Publication No. 48-49425, the number of turns of the secondary winding should be increased or the magnetic flux passing through the core should be increased in order to increase the output voltage of the secondary winding. In that Publication, there has been proposed an ignition coil which includes a magnet disposed in a magnetic circuit for providing a magnetizing force in the direction opposite to the magnetization of the coil in case of closing of a switch for feeding an electric current to the coil. Also, Japanese Patent Publication No. 41-2082 discloses an ignition coil which has a permanent magnet disposed in a magnetic circuit of an iron core to provide the magnetic flux differential to, i.e., opposite to the magnetic flux created in a primary winding. Japanese Patent Laid-open Publication Nos. 59-167006 and 60-218810 disclose an ignition coil having a permanent magnet which is disposed in a gap provided in a core. In any of those described above, the core is provided with a gap at a position other than the position on which the primary and secondary windings are mounted, and the permanent magnet is disposed in the gap.

In the ignition coil having the permanent magnet disposed in the magnetic circuit as mentioned above, the magnetic flux variation produced in response to the intermittent interruption of the primary current is increased, so that the output voltage obtained from the secondary winding is increased in comparison with the conventional ignition coils. However, in such ignition coil, since a great leakage of magnetic flux is created when the electric current is fed to the primary winding, most of the increased magnetic flux is offset by the leaked magnetic flux, so that the increasing rate of the magnetic flux is low. Further, since the permanent magnet is disposed so as to provide a magnetic flux in a direction opposite to the direction of the magnetic flux which is produced when the primary winding is fed with the electric current, the permanent magnet will possibly be demagnetized to thereby reduce the ignition performance.

As for the ignition system for the internal combustion engine, it has been requested more and more to reduce its size. In Japanese Patent Laid-open Publication No. 63-109265 for example, therefore, it has been proposed that the ignition coil is connected directly to the ignition plug, and that the ignition coil is disposed within a cylinder head cover. Then, it is required that the ignition coil is made smaller in size by reducing an area of a cross section of the core perpendicular to the axis of the core. By so doing, however, ignition performances such as an output voltage or a discharge energy will be reduced. Thus, it is necessary for the current ignition coil to fulfill such requirement opposing to each other as the increase of ignition performance on one hand and the reduction in size on the other hand.

SUMMARY OF THE INVENTION

It is, therefore, an object of the present invention to provide an ignition coil for an internal combustion engine to minimize the size of the ignition coil maintaining a predetermined ignition performance.

In accomplishing the above and other objects, an ignition coil for an internal combustion engine includes a core which has at least two parts with a gap formed therebetween. A primary winding and a secondary winding are mounted on the core, so that the gap of the core is substantially enclosed in the primary winding at least. And, a permanent magnet is disposed in the gap of the core to form a substantially closed magnetic circuit with the core. The cross section of the permanent magnet is larger in area than the cross section of the core.

In the above-described ignition coil, the core preferably comprises a first part which is connected to one end face of the permanent magnet, and a second part which is connected to the other end face of the permanent magnet. Each of the first and second parts has a cross section which is identical and smaller in area than the cross section of the permanent magnet.

In the above-described ignition coil, the first part and second part of the core may be made in a U-shape respectively to form a rectangular frame with the permanent magnet disposed between the first part and the second part.

Preferably, the first part has a first enlarged end portion connected to one end face of the permanent magnet, and the second part has a second enlarged end portion connected to the other end face of the permanent magnet, each of the enlarged end portions having the same end face as that of the permanent magnet.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENTS

Figure 1:
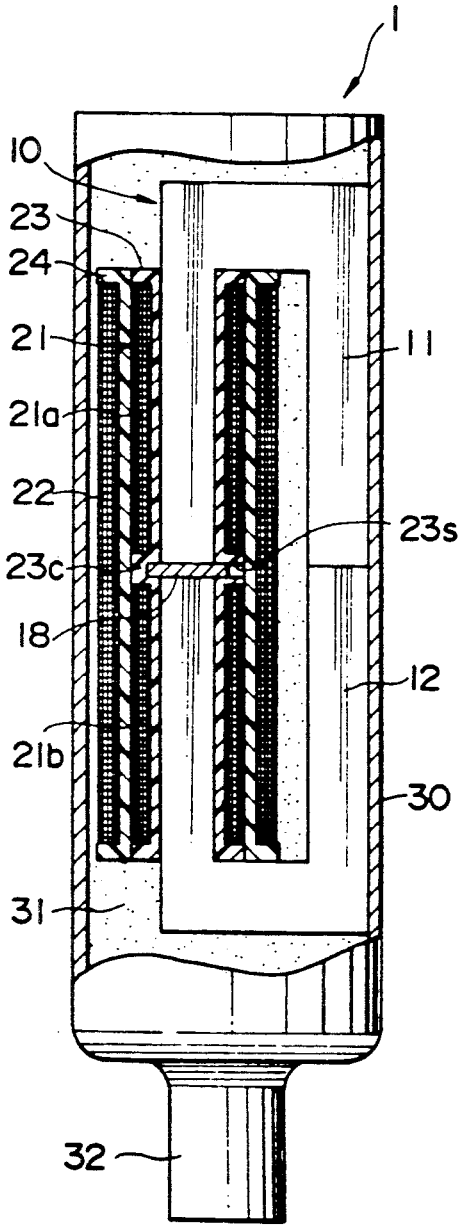
FIG. 1 is a sectional view of an embodiment of an ignition coil according to the present invention.

Referring to FIG. 1, there is illustrated an embodiment of the ignition coil according to the present invention. An ignition coil 1 has a substantially closed magnetic circuit 10 formed by a pair of cores 11, 12 and a permanent magnet 18, on which a first part 21*a* and a second part 21*b* of a primary winding 21 and a secondary winding 22 are mounted. The first part 21*a* and second part 21*b* are wound on a primary bobbin 23 having the permanent magnet 18 disposed therein, while the secondary winding 22 is wound on a secondary bobbin 24. The primary and secondary bobbins 23, 24 are made of synthetic resin and formed in a spool of a rectangular cross section having a small bore defined therein and a spool of a rectangular cross section having a large bore defined therein respectively. The cross section of the primary bobbin 23 and secondary bobbin 24 may be formed in a circular shape or etc. other than the rectangular shape. In the center of the primary bobbin 23, there is provided horizontally a gap 23*s* in which the permanent magnet 18 is disposed. A part of the gap 23*s* is enclosed by a connecting portion 23*c* of the primary bobbin 23 through which a wire passes from the first part 21*a* to the second part 21*b* to form the primary winding 21.

The permanent magnet 18 is disposed in the closed magnetic circuit 10 to provide a magnetic flux in the direction opposite to the direction of the magnetic flux which is produced in the closed magnetic circuit 10 when the electric current is fed to the primary winding 21. The permanent magnet 18 may be disposed in any position between the top and the bottom of the primary bobbin 23 in FIG. 1. It is, however, preferable that the permanent magnet 18 is positioned in the center of the primary bobbin 23, i.e., between the first part 21*a* and second part 21*b* of the primary winding 21. As for the permanent magnet 18, a rare earth magnet of a sintering metal such as samarium-cobalt (Sm-Co) is employed. A rare earth plastic magnet may be employed to reduce eddy currents set up therein and prevent the output voltage from being reduced.

The closed magnetic circuit 10 includes a first core 11 and a second core 12 connected thereto through the permanent magnet 18. Each of the first core 11 and second core 12 is constituted by grain oriented silicon steel plates stacked one on the other which have a good magnetic characteristic in their rolled direction, and are formed in a U-shape. The first and second cores 11, 12 are combined as shown in FIG. 1 to be connected magnetically to each other. Thus, the first and second cores 11, 12 correspond to the first and second parts of the core according to the present invention. The cross sectional area of a portion of each of the cores 11, 12 perpendicular to the longitudinal axis thereof, i.e., a horizontal portion in FIG. 1, is made larger than that of a longitudinal portion of each of the cores 11, 12, i.e., a vertical portion in FIG. 1, for compensating a reduction of the magnetic flux in the horizontal portion. The cross sectional area of a longitudinal portion of each of the cores 11, 12 is made smaller than that of the permanent magnet 18.

The first and second cores 11 and 12, the primary winding 21 mounted on the primary bobbin 23 and the secondary winding 22 mounted on the secondary bobbin 24 are disposed within a case 30 made of synthetic resin. The primary winding 21 has one end connected to a battery (not shown) and the other end connected to a control circuit, i.e., so-called igniter (not shown). The secondary winding 22 has one end connected to the battery together with the one end of the primary winding 21, and the other end connected to an electrode (not shown) in a secondary connector 32 which is molded integrally with the case 30 to be electrically connected to an ignition plug (not shown) or a distributor (not shown). The electrode of the secondary connector 32 is directly connected to the ignition plug according to a known coil distribution ignition system, in which an ignition coil is disposed for each ignition plug instead of the conventional distributor. Then, a thermosetting synthetic resin is filled in the case 30 and set to form a resin portion 31. Thus, the primary and secondary windings 21, 22 are impregnated and made rigid with such resin, and the insulation is ensured to endure the high output voltage obtained from the secondary winding 22.

In operation, when the primary current is intermittently applied with a predetermined frequency to the primary winding 21 of the ignition coil 1 as structured in the above through a control circuit (not shown), the magnetic flux variation is produced in the closed magnetic circuit 10 including the permanent magnet 18. Consequently, a predetermined high voltage is obtained from the secondary winding 22 to be supplied through the secondary connector 32 to the ignition plug directly, or through the distributor. In this operation, a large effective magnetic flux variation is produced by the presence of the permanent magnet 18 disposed between the cores 11 and 12.

Figure 5:
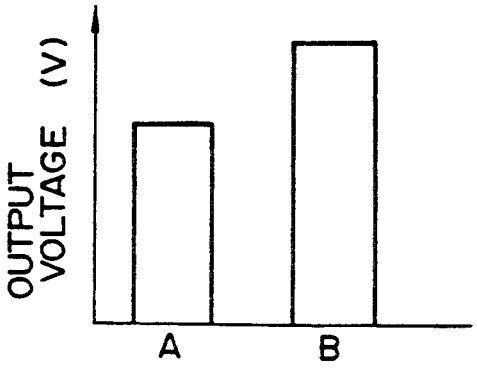
FIG. 5 is a diagram showing the relationship between the output voltage and the cross sectional area of a core in comparison with that of a permanent magnet.

Since the cross sectional area of the permanent magnet 18 is larger than that of the longitudinal portions of the cores 11, 12, the permanent magnet 18 is hardly demagnetized to thereby produce a necessary magnetic flux for the cores 11, 12. FIG. 5 shows the output voltage of the secondary winding obtained in the case where the cross sectional area of the permanent magnet is equal to that of the core (as indicated by "A" in FIG. 5), and the output voltage obtained in the case where the cross sectional area of the permanent magnet is larger than that of the core (as indicated by "B" in FIG. 5). Comparing with these output voltages, it is realized that larger output voltage is obtained when the cross sectional area of the permanent magnet is larger than that of the core. In other words, the cross sectional area of the permanent magnet should be made larger than that of the core in order to minimize the size of the ignition coil with a predetermined output voltage obtained.

At a portion where the permanent magnet 18 is disposed, the closed magnetic circuit 10 is separated in fact, and the magnetic field formed by the permanent magnet 18 and that formed by the primary winding 21 are likely to be dispersed, so that a leakage of magnetic flux can be caused at that portion. In the present embodiment, however, since the permanent magnet 18 is received in the primary bobbin 23, the magnetic flux produced by the primary winding 21 is gathered on that portion to reduce the leakage of the magnetic flux. Consequently, the predetermined output voltage is obtained.

Figure 2:
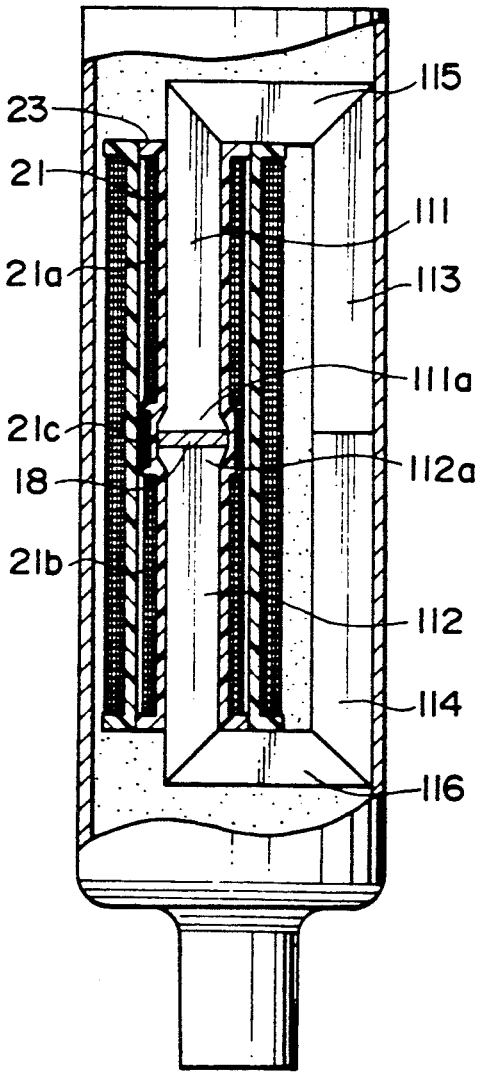
FIG. 2 is a sectional view of another embodiment of an ignition coil according to the present invention.

FIG. 2 shows another embodiment of the present invention, wherein the closed magnetic circuit is constituted by six core members 111 to 116 and the permanent magnet 18. The end faces of the core members 111, 112 are formed in the same shape as the end faces of the permanent magnet 18 respectively, and connected thereto. The cross sections of the end portions 111*a*, 112*a* are, therefore, reduced gradually from their ends to their main bodies to form tapers. The core members 111 to 116 are connected to one another to form a rectangular frame. Each of the core members 111 to 116 has a connecting end which is inclined to form right angle with a connecting end of the core member connected to it. These core members 111 to 116 are made of grain oriented silicon steel plates stacked one on the other, so that they have good magnetic characteristics in their longitudinal directions. Thus, the core members 115, 116 disposed perpendicularly to the longitudinal direction of the core members 111 to 114, i.e., horizontally in FIG. 2, are formed in the same cross sections as those of the core members 111 to 114. According to this embodiment, therefore, the longitudinal length of the core is also reduced to minimize the size of the ignition coil. In this embodiment, the primary bobbin 23 is made by plastic molding to enclose the core members 111, 112 and the permanent magnet 18 as well. Then, the primary winding 21 which includes three parts 21*a*, 21*b* and 21*c* is mounted on the primary bobbin 23. Thus, the permanent magnet 18 connected to the core members 111, 112 is also enclosed by the part 21*c* of the primary winding 21 to effectively reduce the leakage of magnetic flux.

Figure 3:
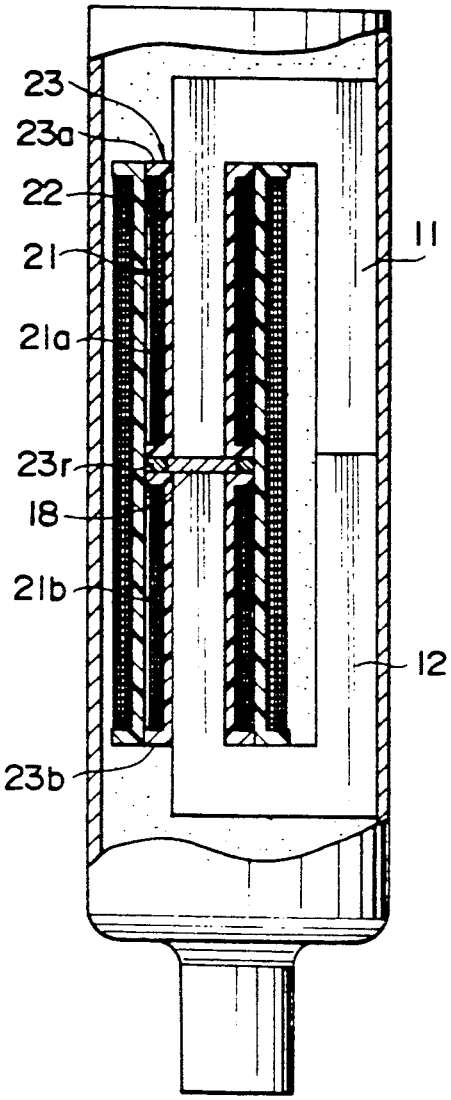
FIG. 3 is a sectional view of a further embodiment of an ignition coil according to the present invention.

FIG. 3 shows a further embodiment of the present invention, the primary bobbin 23 comprises a pair of spools 23*a*, 23*b* which are connected to each other through a plastic ring member 23*r*. In a space formed in the ring member 23*r* having larger cross sectional area than that of the space in the spools 23*a*, 23*b*, the permanent magnet 18 is disposed, and connected to the first core 11 and second core 12. Accordingly, the permanent magnet 18 is positioned in the ring member 23*r* and held between the spools 23*a* and 23*b*. The first part 21*a* of the primary winding 21 is connected to the second part 21*b* thereof through the ring member 23*r*. The remaining structure is substantially same as that of FIG. 1, so that explanation thereof will be omitted. According to this embodiment, the spools 23*a* and 23*b* of the primary bobbin 23 are identical to be manufactured easily, and the permanent magnet 18 is easily assembled between the spools 23*a* and 23*b*.

Figure 4:
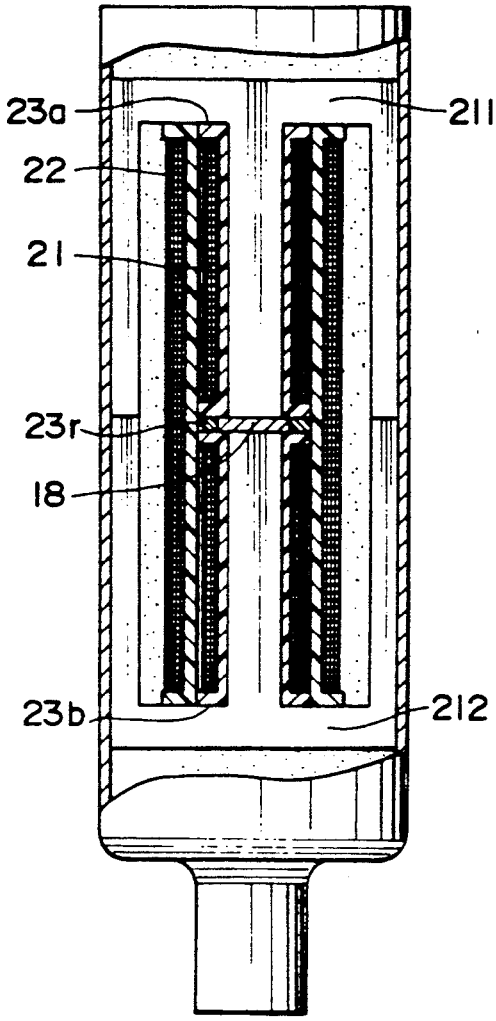
FIG. 4 is a sectional view of an alternative embodiment of an ignition coil according to the present invention.

FIG. 4 shows a yet further embodiment of the present invention, in which a first core 211 and a second core 212 are formed in an E-shape respectively, while the first core 11 and second core 12 are formed in a U-shape in FIG. 3. The remaining structure is substantially same as that of FIG. 3, so that explanation thereof will be omitted. According to this embodiment, a pair of closed magnetic circuits are formed and the longitudinal length of the ignition coil can be reduced in comparison with the embodiment as shown in FIG. 3.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a core having at least two parts with a gap formed therebetween;

a primary winding and a secondary winding mounted on a said core, said gap of said core being substantially enclosed in said primary winding at least; and a permanent magnet disposed in said gap of said core perpendicular to a longitudinal axis thereof for forming a substantially closed magnetic circuit with said core, the cross section of said permanent magnet being larger in area than the cross section of said core, wherein said core comprises a first part connected to one end face of said permanent magnet, and a second part connected to the other end face of said permanent magnet, the cross sections of said first and second parts being identical and smaller in area than the cross section of said permanent magnet, and said first part has a first enlarged end portion connected to one end face of said permanent magnet, and said second part has a second enlarged end portion connected to the other end face of said permanent magnet, each of said first and second enlarged end portions having the same size end face as that of said permanent magnet.

2. An ignition coil for an internal combustion engine as set forth in claim 1, wherein said first part and second part of said core are made in a U-shape respectively to form a rectangular frame with said permanent magnet disposed between said first part and said second part.

3. An ignition coil for an internal combustion engine as set forth in claim 2, including a primary bobbin for mounting thereon said primary winding and receiving therein said permanent magnet, and a secondary bobbin for mounting thereon said secondary winding and receiving therein said primary bobbin with said primary winding mounted thereon.

4. An ignition coil for an internal combustion engine as set forth in claim 1, wherein the cross sectional areas of said first and second enlarged end portions are reduced gradually from the ends thereof toward the bodies thereof to form a taper respectively.

5. An ignition coil for an internal combustion engine as set forth in claim 4, wherein said first part and second part of said core are made in a U-shape respectively to form a rectangular frame with said permanent magnet disposed between said first part and said second part.

6. An ignition coil for an internal combustion engine as set forth in claim 1, wherein said core comprises six core members formed in an I-shape respectively and connected to one another to form a rectangular frame with said permanent magnet disposed in said gap, and wherein the cross sectional areas of said core members are identical.

* * * * *